US006014826A

United States Patent [19]

Walgren et al.

[11] Patent Number: 6,014,826

[45] Date of Patent: Jan. 18, 2000

[54] CHAIN FOR TRENCHER APPARATUS

[76] Inventors: Craig B. Walgren, 210 Comanche La.; John H. Walgren, 1530 County Shire, both of Lake Havasu City, Ariz. 86403

[21] Appl. No.: 08/881,821

[22] Filed: Jun. 24, 1997

[51] Int. Cl.[7] ..... E21C 35/18

[52] U.S. Cl. ..... 37/456; 37/465; 299/100

[58] Field of Search ..... 37/450, 452, 455, 37/454, 456, 465; 299/100, 91

[56] References Cited

U.S. PATENT DOCUMENTS

| | | | |
|---|---|---|---|
| 2,675,219 | 4/1954 | Proctor . | |
| 2,780,004 | 2/1957 | Rosenbaum . | |
| 2,807,452 | 9/1957 | Joy . | |
| 2,989,295 | 6/1961 | Prox, Jr. | 299/108 |
| 3,063,691 | 11/1962 | Osgood | 37/455 X |
| 3,223,452 | 12/1965 | Krekeler | 299/92 |
| 3,484,844 | 12/1969 | Petersen . | |
| 3,498,677 | 3/1970 | Morrow | 37/456 X |
| 3,614,164 | 10/1971 | Davis | 299/83 |
| 3,841,709 | 10/1974 | Kniff | 299/108 X |
| 3,913,979 | 10/1975 | Strauss et al. | 299/84 |
| 3,968,995 | 7/1976 | Arentzen | 299/76 |
| 4,089,561 | 5/1978 | Carden | 299/83 |
| 4,143,920 | 3/1979 | Haddock | 299/79 |
| 4,212,559 | 7/1980 | Persson | 37/456 X |
| 4,404,761 | 9/1983 | Paulin et al. | 299/108 X |
| 4,462,638 | 7/1984 | DenBesten | 37/456 X |
| 4,775,189 | 10/1988 | Den Besten | 299/82 |
| 5,248,188 | 9/1993 | Walgren | 299/83 |

FOREIGN PATENT DOCUMENTS

| | | | |
|---|---|---|---|
| 1350451 | 12/1963 | France | 299/91 |
| 1033729 | 8/1983 | Russian Federation | 299/91 |
| 1081573 | 8/1967 | United Kingdom | 299/91 |

*Primary Examiner*—Christopher J. Novosad
*Attorney, Agent, or Firm*—Tod R. Nissle, P.C.

[57] ABSTRACT

A trencher includes a frame. Ground engaging wheels and a chain are mounted on the frame. Sleeves are attached to and extend outwardly from the chain. Rotatable and fixed-orientation teeth can be mounted in the sleeves.

7 Claims, 3 Drawing Sheets

FIG. 4
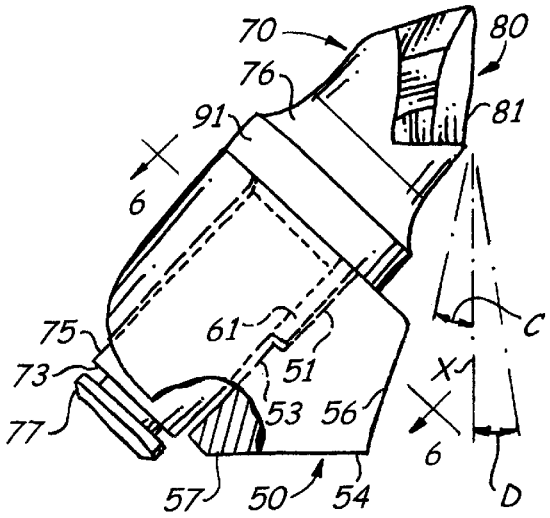
FIG. 5
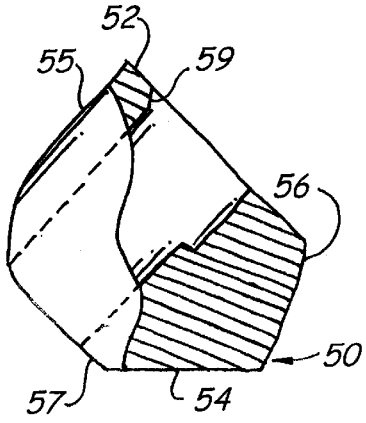
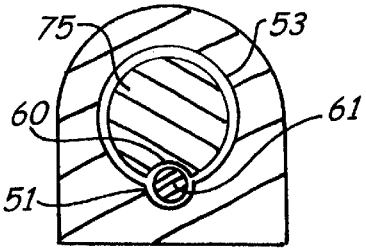
FIG. 6
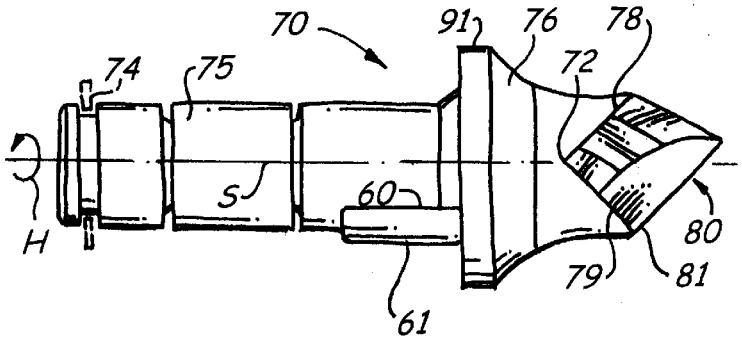
FIG. 7

CHAIN FOR TRENCHER APPARATUS

This invention relates to apparatus for forming a trench.

More particularly, the invention relates to trenching apparatus of the type including a frame having wheels or other means for moving the frame over the ground, sleeves attached to and extending outwardly from the frame, cutting teeth mounted in the sleeves, and motor mounted in the frame for driving the sleeves such that the tooth can dig a trench in the ground.

In a further respect, the invention relates to trenching apparatus of the type described which can utilize either rotatable or fixed-orientation teeth.

Trenching apparatus is well know in the art. See, for example, U.S. Pat. No. 2,675,219 to Proctor, U.S. Pat. No. 2,780,004 to Arps, U.S. Pat. No. 2,807,452 to Joy, U.S. Pat. No. 3,223,452 to Krekeler, U.S. Pat. No. 3,484,844 to Peterson, U.S. Pat. No. 3,614,164 to Davis, U.S. Pat. No. 3,913,979 to Strauss et al., U.S. Pat. No. 3,968,995 to Arentzen, U.S. Pat. No. 4,089,561 to Carden, U.S. Pat. No. 4,143,920 to Haddock, U.S. Pat. No. 4,404,761 to Paulin et al., U.S. Pat. No. 4.775,189 to Den Besten, and 5,248,188 to Walgren. Such conventional trenching machines often include a frame having ground engaging wheels, a boom attached to and extending outwardly from the frame, a chain which extends around the periphery of the boom (in much the same manner that a chain extends around the boom of a chain saw), a plurality of cutting teeth mounted in sleeves on the chain, and a motor mounted in the frame for driving the chain around the boom such that the chain can dig a trench in the ground. Large sized conventional trenching machines utilize a chain drive motor having a horse power of 60 or more. The cutting teeth in such over sized machines are conical, have a maximum width in excess of about ¾ inch, and rotate in sleeves while the trenching machine chain moves. Rotation of the teeth is critical because it facilitates the even distribution of wear over the conical surface of the teeth. However, one of the principal disadvantages associated with prior art trenching machines is that the cutting teeth which are mounted in sleeves on the chain wear more rapidly than the chain. The constant rotation of the teeth during operation of the chain exacerbates tooth wear. This is why most present day trenching machines use teeth which can be removed from sleeves on the chain and replaced by new teeth. Removing and replacing the teeth on the chain of a trenching machine is time consuming and expensive.

Accordingly, it would highly desirable to provide improved trenching apparatus of the type described in which the life of the teeth was significantly increased in comparison to conventional teeth.

Therefore, it is a principal object of the invention to provide improved trenching equipment.

A further object of the invention is to provide improved trenching equipment of the type including a frame mounted on wheels or other means for moving the frame over the ground, a plurality of sleeves mounted on the frame, a plurality of cutting teeth mounted in the sleeves, and a motor mounted in the frame for driving the sleeves such that the teeth can dig a trench in the ground.

Another object of the invention is to provide improved trenching equipment of the type described in which the cutting teeth are shaped and dimensioned and mounted in the sleeves such that the operational life of the cutting teeth is increased and such that the rotation, and concomitant wear, of the teeth can be eliminated.

Still a further object of the invention is to provide improved trenching equipment of the type described which can utilize either rotatable teeth or fixed-orientation teeth.

These and other, further and more specific objects and advantages of the invention will be apparent to those skilled in the art from the following detailed description thereof taken in conjunction with the drawings, in which:

FIG. 4 is a side partial section view illustrating a sleeve constructed in accordance with the invention with a fixed-orientation tooth mounted therein;

FIG. 5 is a side partial section view illustrating the sleeve of FIG. 4;

FIG. 6 is a section view further illustrating the sleeve and tooth of FIG. 4 and taken along section line 6—6 thereof;

FIG. 7 is a side elevation view illustrating the fixed orientation tooth of FIG. 4;

Figure 1:
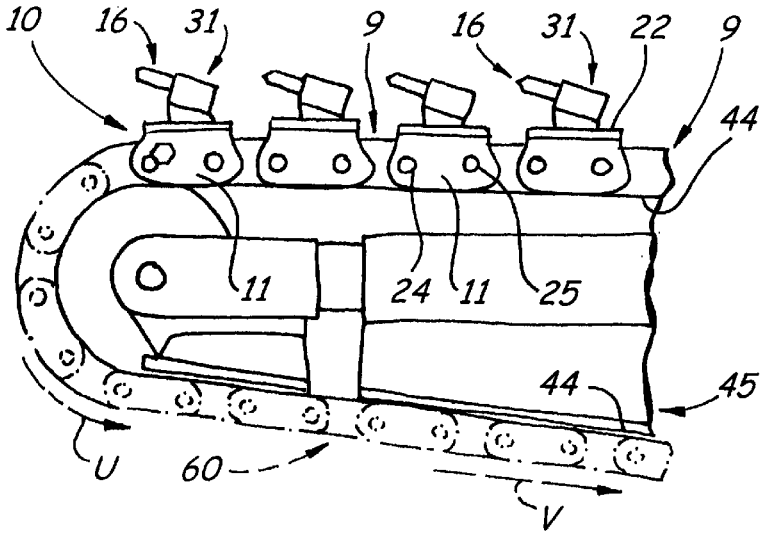
FIG. 1 is side elevation view illustrating the chain and boom of a conventional trencher apparatus equipped with conically tipped, rotating cutting teeth.

Briefly, in accordance with our invention, we provide improved excavation apparatus including a frame including apparatus engaging the ground to enable the frame to move over the ground; a plurality of tooth sleeves attached to and extending away from the frame, each of the tooth sleeves including an aperture formed therein; a plurality of teeth each mounted in one of the apertures and including a cylindrical body, the aperture being shaped to dimensioned to slidably receive the cylindrical body and permit the body to rotate therein, and a bit attached to the body and extending outwardly away from the aperture; a slot formed in each of the apertures and extending away from the cylindrical body of one of the teeth mounted in the aperture; and, a pin operatively associated with each of the apertures and the teeth. The pin is slidably inserted in the slot in one of the apertures and engages the cylindrical body of one of the teeth inserted in the one of the apertures to prevent the rotation in the aperture of the one of the teeth.

In another embodiment of the invention, we provide improved excavation apparatus including a frame including apparatus engaging the ground to enable the frame to move over the ground; a plurality of tooth sleeves attached to and extending away from the frame, each of the tooth sleeves including an aperture formed therein; a plurality of rotatable teeth each adapted to be mounted in one of the apertures for rotation therein. The rotatable teeth each include a cylindrical body, the aperture being shaped to dimensioned to slidably receive the cylindrical body and permit the body to rotate therein, a neck attached to and flaring out from the body, the neck being wider than said aperture, and a bit attached to the neck and extending outwardly away from the body, the bit and tooth turning with respect to the one of said apertures when the apparatus is used to excavate. The excavation apparatus also includes a plurality of fixed-orientation teeth each adapted to be mounted in a selected fixed position in one of said apertures. The fixed-orientation teeth each include a cylindrical body, the one of the apertures being shaped to dimensioned to slidably receive the cylindrical body of the fixed-orientation tooth and permit the body to rotate therein; a neck attached to and flaring out from the body of the fixed-orientation tooth, the neck of the fixed-orientation tooth being wider than the one of the apertures; and, a bit attached to the neck and extending outwardly away from the body of the fixed orientation tooth. The excavation apparatus also includes a plurality of pins each operatively associated with each of the apertures. The pins engage one of the fixed-orientation teeth inserted in one of the apertures to prevent the rotation in one of the apertures of the one of the fixed-orientation teeth. Only the fixed-orientation teeth or only the rotatable teeth can be mounted in the apertures at any given time.

In a further embodiment of the invention, I provide improved excavation apparatus including a frame including apparatus for engaging the ground to enable the frame to move over the ground; a plurality of tooth sleeves attached to and extending away from the frame, each of said tooth sleeves including an aperture formed therein; and, a plurality of fixed-orientation teeth each adapted to be mounted in a selected fixed position in one of the apertures. Each of the teeth include a cylindrical body, the aperture being shaped to dimensioned to slidably receive the cylindrical body and permit the body to rotate therein; a neck attached to said body; and, a bit attached to the neck and extending outwardly away from the aperture. The excavation apparatus also includes a plurality of pins each operatively associated with one of the apertures and one of the teeth. The pin engages a tooth inserted in one of the apertures to prevent the rotation of the tooth in the aperture.

Figure 3:
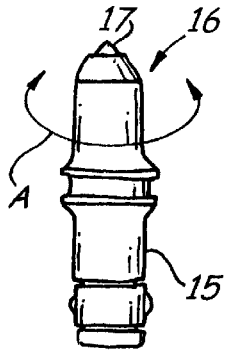
FIG. 3 is a side elevation view illustrating a conically tipped rotatable cutting tooth utilized on the trencher chain of FIG. 1.
Figure 2:
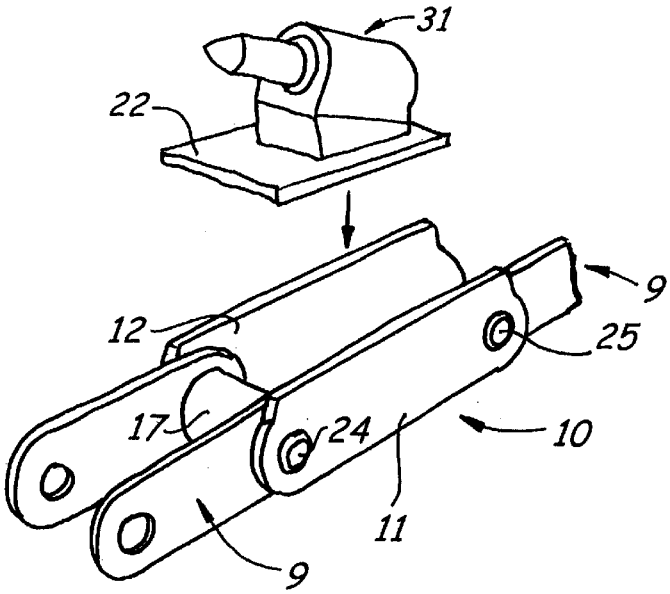
FIG. 2 is a exploded perspective view illustrating the construction of the chain, sleeves, and cutting teeth utilized in trenching apparatus of FIG. 1.

Turning now to the drawings, which depict the presently preferred embodiments of the invention for the purpose of illustrating the practice thereof, and not by way limitation of the scope of the invention, an in which like reference characters refer to corresponding elements throughout the several views, FIGS. 1, 2 and 3 illustrate a sleeve and cutting tooth construction which is found on conventional trenching machines and includes alternating connector links 10 and roller links 9. Each connector link 10 includes a plate 22. In FIG. 1, plates 22 are horizontally oriented and are each attached (typically welded) to the upper edge of a pair of parallel opposed spaced apart plates 11, 12. One of these plates 11 is visible for each connector link 10 in FIG. 1. The opposing plates 12 in each connector link 10 are not visible in FIG. 1. Each of the parallel opposed spaced apart pair of plates 11, 12 comprising a connector link 10 is of equal shape and dimension. A pair of apertures is formed through each plate 11. A pair of apertures (not visible in FIG. 1) is formed through the other plate 12 of each connector link 10. Each plate 12 is parallel to, opposed to, and spaced apart from it associated plate 11. Pins 24 and 25 each extend through an aligned aperture pair in plates 11 and 12 and through a hollow cylindrical member 17 of a roller link 9 in the manner shown in FIG. 2 to pivotally interconnect a roller link 9 with a connector link 10. The configuration of each connector link 10 in FIG. 1 is generally equivalent to the configuration of connector link 10 in FIG. 2. The configuration of each roller link 9 in FIG. 1 is generally equivalent to the roller link 9 in FIG. 2.

In FIG. 1, a tooth sleeve 31 is welded or otherwise fixedly secured to each plate 22. Each tooth sleeve 31 includes a cylindrical aperture which slidably receives the neck 15 of a tooth 16 such that neck 15 can rotate in the aperture in the directions indicated by arrows A in FIG. 3. Each conventional tooth 16 includes a conical tip 17. One or more tooth sleeve 31—tooth 16 assemblies can be affixed to the plate 22 of a connector link 10.

In FIG. 1 connector links 10 and roller links 9 comprise chain 60 which travels about the periphery 44 of the boom 45 of a trenching machine. The boom 45 is mounted in conventional fashion to a frame (not shown in FIG. 1) having ground engaging wheels, continuous jointed metal belts, or other means for enabling the frame to move over the ground. A motor (not shown) is mounted on the frame and drives the continuous, endless chain 60 in the direction of arrow T about the periphery 44 of boom 45, in much the same fashion that the chain on a chain saw is driven about the periphery of the chain saw boom in order to cut wood. Frames, motors, booms, and means for mounting the booms on frames are well known in the trenching apparatus art and will not be discussed here. The travel of endless chain 60 about the peripheral edge 44 of boom 45 is further indicated by dashed arrows U and V in FIG. 1.

The sleeve 50 and fixed-orientation tooth 70 constructed in accordance with the invention are shown in greater detail in FIGS. 3 to 7. Sleeve 50 includes bottom surface 54, front surface 56 and back under surface 57, each upwardly depending from bottom surface 54. Upper surface 55 co-terminates with undersurface 57 and contact surface 52. In FIG. 7, contact surface 52 is presently preferably normal to surface 55. Cylindrical aperture 53 is formed through sleeve 50. Semi-cylindrical groove 51 is formed in sleeve 50 and is contiguous to aperture 53. Countersunk conical aperture 59 interconnects aperture 53 and surface 52.

As shown in FIGS. 4 and 7, tooth 70 includes cylindrical body 75 connected at one end to cylindrically-shaped collar or neck 91. A cylindrical U-shaped groove 73 is formed in the other end of body 75. The other end of body 75 also includes conical surface 77. Conical surface 76 interconnects collar 91 and the jaw configuration of tooth 70. The jaw configuration receives a carbide bit 80 and includes planar semi-circular surface 78 which co-terminates along line 72 with planar semi-circular surface 79. Surface 78 is presently, but not necessarily, normal to surface 79. Bit 80 includes cutting edge 81. Semi-cylindrical groove 60 is formed in body 75.

When neck 75 of tooth 70 is slidably inserted in aperture 53 of sleeve 50 in the manner shown in FIG. 4, a snap washer 74 is inserted in groove 73 in the manner shown in FIG. 7. Snap washer 74 has an outer diameter greater than the diameter of aperture 53 and prevents tooth 70 from being withdrawn from aperture 53. Snap washer 74 is readily removed from groove 73 when it is desired to remove tooth 70 from sleeve 50 to insert a new replacement tooth 70. In FIG. 6, pin 61 is slidably inserted in grooves 51 and 60 in the manner shown in FIG. 6 so that tooth 70 cannot rotate in aperture 53 around longitudinal axis S in the direction indicated by arrow H in FIG. 7. Axis S is the centerline of tooth 70. The prevention of such rotation is critical in use of the tooth 70. Once the sleeve 50 is secured to a plate 22, the cutting edge 81 of tooth 70 normally must be in a selected orientation with respect to plate 22, which selected orientation must remain fixed. Pin 61 performs the function of preventing the rotation of tooth 70 while permitting the flared collar 91 to bear against surface 52. Flared collar 91 is important because it shields surface 52 of sleeve 50 and minimizes the wear of sleeve 50.

Pin 61 can, if desired, be permanently seated in groove 60 and attached to body 75 so that pin 61 and body 75 are simultaneously slid into and removed from aperture 53. Or, the configuration of body 75 and pin 61 shown in FIG. 7 can be formed as a single unitary component.

Whenever tooth 70 is mounted in sleeve 50, pin 61 is slid into and seats in semi-cylindrical grooves 51 and 60 to prevent body 75 from rotating about axis S while body 75 is in aperture 53. Grooves 51 and 60 are adjacent and oppose one another.

Figure 8:
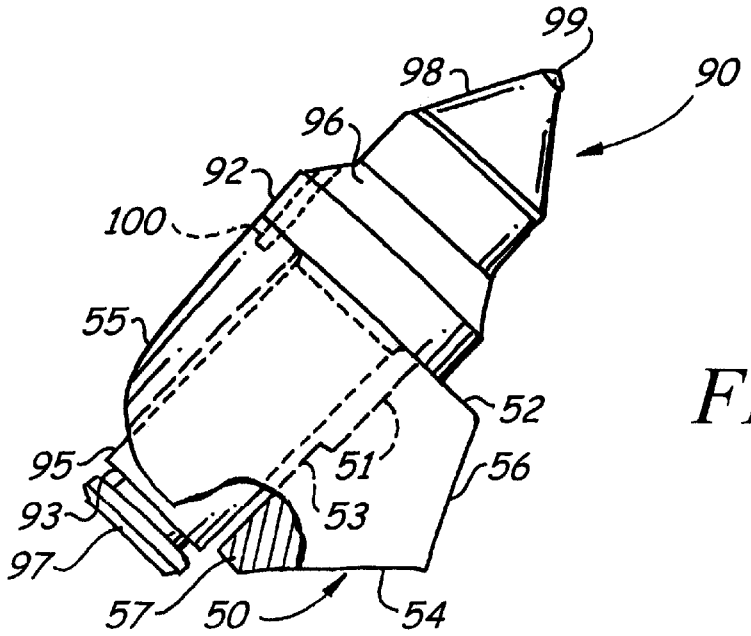
FIG. 8 is a side partial section view illustrating the sleeve of FIG. 5 with a rotatable conically-tipped tooth mounted therein; and, FIG. 9 is a side elevation view of the conically-tipped tooth of FIG. 8.
Figure 9:
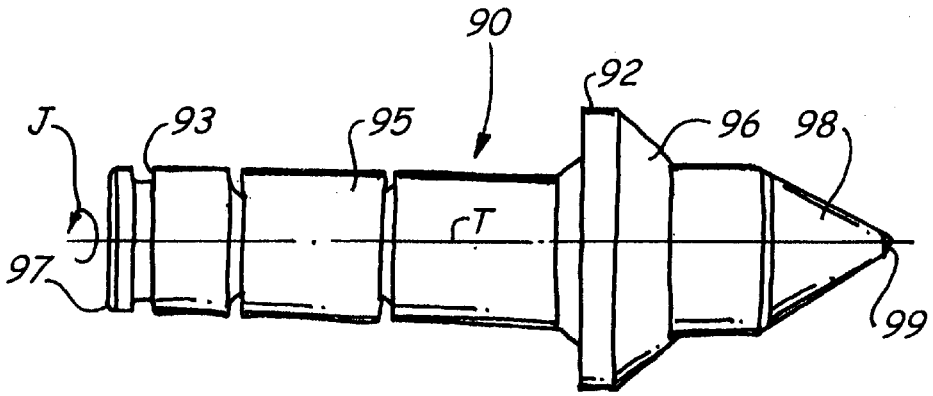

As shown in FIGS. 8 and 9, rotatable tooth 90 includes cylindrical body 95 connected at one end to cylindrically-shaped collar or neck 92. A cylindrical U-shaped groove 73 is formed in the other end of body 95. The other end of body 95 also includes conical surface 97. Conical surface 96 interconnects collar 92 and the conical end 98 of tooth 90. A cutting tip 99 is seated in end 98.

Whenever rotatable tooth 90 is mounted in sleeve 50 in the manner shown in FIG. 8, a pin 61 is not utilized, semi-cylindrical groove 51 is open, and body 95 is free to rotate about axis T when body 95 is in aperture 53. A semi-cylindrical groove 60 can, but need not be, formed in body 95.

As would be appreciated by those of skill in the art, a wide variety of pin or other mechanical configurations and apparatus can be utilized to prevent a tooth from rotating when it is inserted in aperture 53. By way of example, and not limitation, a pin 100 can be inserted in openings which are aligned and are formed through collar 92 and in sleeve 50. The pin 61 configuration presently utilized is preferred because it permits pin 61 and body 75 to be inserted simultaneously in aperture 53, it permits pin 61 and body 75 to be simultaneously removed from aperture 53, it does not require alteration of the neck 92 and surface 76 and/or bit 80 of the tooth, and, it permits the use of conventional flared rotatable bits 90 as wells as flared fixed-orientation bits 70. In addition, in use, pin 61 is housed and secured in aperture 53 inside of sleeve 50, which greatly reduces any risk that pin 61 can escape from and fly out from sleeve 50 during utilization of sleeve 50 and a tooth 70 to excavate soil, concrete, minerals, or other materials.

As noted above and in FIGS. 1 and 2, teeth 70, 90 and sleeves 50 can be mounted on a driven endless chain which is mounted on a boom. Means are provided to drive the chain around the boom, much like a chain is driven around the boom of a chain saw. However, as would be appreciated by those of skill of the art, teeth 70 and 90 and sleeves 50 can be mounted on any other kind of boom or on any other mechanical device or configuration which permits the sleeves 50 and teeth mounted therein to be displaced and/or driven to excavate a desired material.

In use, sleeves 50 and teeth 70 and 90 are provided. Sleeves 50 are mounted on plates 22. A mixture of teeth 70 and 90 can be mounted in sleeves 50. It is, however, normally preferred that only teeth 70 or only teeth 90 be mounted in the sleeves 50 on a chain 60. When teeth 70 are utilized, a pin 61 is inserted with body 75 in the manner shown in FIG. 4 in order to insure that body 75 and tooth 70 will not rotate about axis S while tooth 70 is in aperture 53. When teeth 90 are utilized, they are each mounted in a sleeve 50 in the manner shown in FIG. 8. Pins 61 are not utilized when teeth 90 are utilized. It is, however, possible that a tooth 90 which normally would rotate in sleeve 50 about axis T during use, can be provided with a semi-cylindrical groove 60 which would enable a pin 61 to be utilized to prevent the rotation of the tooth 90. E.g., the shape and dimension and bit utilized on a fixed-orientation or rotatable tooth can vary as desired.

When fixed-orientation tooth 70 is inserted in sleeve 50 in the manner shown in FIG. 4, and when the flat planar bottom surface 54 is parallel to and resting on a flat plate 22, then linear cutting edge 81 is ordinarily preferably parallel to an axis X which is perpendicular to plate 22. When sleeve 50 and tooth 70 are in the orientation shown in FIG. 6 and surface 54 is resting on and parallel to plate 22, bit 80 can, however, be shaped and dimensioned such that straight linear cutting edge 81 (or a portion of cutting edge 81) is canted at an angle, indicated by arrows C to axis X, or, is canted at an angle, indicated by arrows D, to axis X. In FIG. 4, edge 81 is parallel to the plane of the sheet of paper upon which the drawing of FIG. 4 is made, regardless of whether edge 81 is parallel to axis X or is canted at an angle C or D with respect to axis X. It is, as would be appreciated by those of skill in the art, also possible to fixedly attach sleeve 50 to a plate 22 and to tilt sleeve 50 on that plate 22 such that when tooth 70 is position in sleeve 50 in the manner shown in FIG. 4, edge 81 of tooth 70 is canted with respect to the plane of the sheet of paper upon which the drawing of FIG. 4 is made. Regardless of the desired position and orientation of edge 81 (and tooth 70) with respect to axis X and the plane of the sheet of paper of the drawings, once fixed-orientation tooth 70 is inserted in aperture 53, it is ordinarily important to maintain and fix the orientation of tooth 70 and edge 81 with respect to sleeve 50. Pin 61 and semi-cylindrical grooves 51 and 60 perform the function of maintaining tooth 70 in fixed position in sleeve 50.

The diameter of body 75 or 95 is typically 0.735 inch, 0.765 inch, 0.875 inch, 0.990 inch, or 1.187 inch.

The locking design (i.e., pin 61) of the invention is protected from abrasion wear because pin 61 is located inside sleeve 50.

The locking design of the invention allows the use in sleeve 50 of a conical tooth 90 which has a "wide flair" collar 96 and which can freely rotate in sleeve 50. When it is desired that tooth 90 freely rotate in sleeve 50, then locking pin 61 is not utilized.

Alternatively, the locking design of the invention allows the use in sleeve 50 of a tooth 70 which can not during use rotate in sleeve 50. Locking pin 61 is utilized in the manner shown in FIGS. 4, 6 and 7 to prevent the rotation of such a tooth 70.

One or more pins 61 and grooves 51, 60 can be utilized in conjunction with a tooth 70 to prevent the rotation of the tooth 70 in aperture 53.

Each pin 61 utilized in conjunction with a tooth 70 can, if desired, be permanently attached to or integrally formed with the tooth 70.

Having described my invention in such terms as to enable those skilled in the art to make and use it, and having described the presently preferred embodiments thereof,

We claim:

1. Excavation apparatus including (a) a frame including means engaging the ground to enable said frame to move over the ground;

(b) a plurality of tooth sleeves attached to and extending away from said frame, each of said tooth sleeves including an aperture formed therein;

(c) a plurality of teeth each mounted in one of said apertures and including a cylindrical body having a longitudinal axis (S), said apertures each being shaped and dimensioned to slidably receive said cylindrical body and permit said body to rotate therein, and a bit attached to said body and extending outwardly away from said one of said apertures;

(d) a slot formed in each of said apertures, having a longitudinal axis generally parallel to said longitudinal axis of said cylindrical body, and extending away from said cylindrical body of one of said teeth mounted in said aperture; and, (e) pin means slidably inserted in each of said slots and having a longitudinal axis parallel to said longitudinal axis of said slot, said pin means engaging said cylindrical body of one of said teeth inserted in said one of said apertures to prevent the rotation in said one of said apertures of said one of said teeth.

2. The apparatus of claim 1 wherein each of said pin means is fixedly attached to said body of one of said teeth.

3. Excavation apparatus including (a) a frame including engaging the ground to enable said frame to move over the ground;

(b) a plurality of tooth sleeves attached to and extending away from said frame, each of said tooth sleeves including an aperture formed therein;

(c) a plurality of rotatable teeth each adapted to be mounted in one of said apertures for rotation therein and including a cylindrical body, said one of said apertures being shaped and dimensioned to slidably receive said cylindrical body of one of said teeth and to permit said body of said one of said teeth to rotate therein, a neck attached to and flaring out from said body, said neck being wider than each of said apertures, and a bit attached to said neck and extending outwardly away from said body;

(d) a plurality of fixed-orientation teeth (70) each adapted to be mounted in a selected fixed position in one of said apertures and including a cylindrical body having a longitudinal axis (S), said one of said apertures being shaped and dimensioned to slidably receive said cylindrical body of one of said fixed-orientation teeth and to permit said body of said one of said fixed-orientation teeth to rotate therein, a neck attached to and flaring out from said body of said one of said fixed-orientation teeth, said neck of said one of said fixed-orientation teeth being wider than each of said apertures, and a bit attached to said neck and extending outwardly away from said body of said one of said fixed orientation teeth; and (e) pin means removably slidably inserted in each of said apertures in which said fixed-orientation teeth are mounted and having a longitudinal axis parallel to said longitudinal axis (S) of said cylindrical body of said fixed-orientation teeth in said aperture, said pin means engaging said cylindrical body of one of said fixed-orientation teeth to prevent the rotation in said apertures of said fixed-orientation teeth.

4. The apparatus of claim 3 wherein only one of a pair comprising (a) said plurality of fixed-orientation teeth; and, (b) said plurality of rotatable teeth; and is mounted in said apertures at any given time.

5. Excavation apparatus including (a) a frame including means engaging the ground to enable said frame to move over the ground;

(b) a plurality of tooth sleeves attached to and extending away from said frame, each of said tooth sleeves including an aperture formed therein;

(c) a plurality of fixed-orientation teeth each adapted to be mounted in a selected fixed position in one of said apertures and including a cylindrical body having a longitudinal axis, said one of said apertures being shaped and dimensioned to slidably receive said cylindrical body and permit said body to rotate therein, a neck attached to said body, a bit attached to said neck and extending outwardly away from said aperture; and, (d) pin means removably slidably inserted in each of said apertures and having a longitudinal axis parallel to said longitudinal axis (S) of said cylindrical body of said fixed-orientation teeth in said aperture, said pin means engaging said cylindrical body of one of said fixed-orientation teeth to prevent the rotation in said apertures of said fixed-orientation teeth.

6. The apparatus of claim 5 wherein each of said pin means is fixedly attached to said body of one of said teeth.

7. The apparatus of claim 5 wherein (a) said neck of each of said teeth flares out from said body of said teeth and is wider than each of said apertures, and (b) said pin means extends from said neck into said aperture.

* * * * *